US005503095A

United States Patent [19]

Burt et al.

[11] Patent Number: 5,503,095

[45] Date of Patent: Apr. 2, 1996

[54] EDGE BINDING APPLYING APPARATUS AND METHOD

[75] Inventors: Donald E. Burt, Danvers; Henry R. Cofek, Groton, both of Mass.

[73] Assignee: Design Technology Corporation, Billerica, Mass.

[21] Appl. No.: 337,738

[22] Filed: Nov. 14, 1994

[51] Int. Cl.[6] ..... D05B 21/00

[52] U.S. Cl. ..... 112/470.14; 112/475.09

[58] Field of Search ..... 112/470.14, 470.08, 112/475.12, 475.13, 152, 475.16, 220, 418, 470.09, 153, 311, 320, 305

[56] References Cited

U.S. PATENT DOCUMENTS

| | | | |
|---|---|---|---|
| 4,532,875 | 8/1985 | Gazzarrini | 112/470.08 |
| 4,546,714 | 10/1985 | Sanvito | 112/220 X |
| 4,593,635 | 6/1986 | Boser et al. | 112/152 X |
| 4,803,937 | 2/1989 | Hiramatsu et al. | 112/475.16 |
| 5,417,174 | 5/1995 | Allison et al. | 112/475.13 X |

*Primary Examiner*—Ismael Izaguirre
*Attorney, Agent, or Firm*—Rhodes Coats & Bennett

[57] ABSTRACT

An apparatus for applying a binding material to the edge of a leg opening in a pair of unfinished men's briefs during the manufacturing thereof. The apparatus includes a holding fixture for receiving and holding the pair of men's briefs before the crotch is sewn such that the edge of the leg opening is stretched longitudinally. A conveyor conveys the holding fixture to a staging mechanism for engaging and positioning the edge of the leg opening while the brief is conveyed in the holding fixture. A sewing apparatus disposed adjacent the staging mechanism sews the binding material to the edges of the leg openings as the holding fixture is conveyed through the sewing apparatus. A trimmer disposed adjacent the output side of the staging mechanism trims the binding material after it is applied to the leg opening.

23 Claims, 10 Drawing Sheets

EDGE BINDING APPLYING APPARATUS AND METHOD

BACKGROUND OF THE INVENTION (1) Field of the Invention

The present invention relates generally to automated manufacturing systems and, more particularly, to an apparatus for applying binding around the leg opening of a pair of men's briefs or the like. (2) Description of the Prior Art The manufacture of textile clothing articles such as briefs, tee-shirts, and other garments has resisted automation. This is due largely because of the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. Such detectors, when attached to a sewing machine and guide means can allow some automation of common sewing operations such as binding an edge of a pre-cut fabric piece. However, such operations still require the use of a skilled operator to feed the fabric piece to the sewing machine and usually carry out only one sewing operation at a time.

Thus, there remains a need for an apparatus for applying binding around the leg opening of a pair of men's briefs or the like which can be carried out completely automatically without the need for a skilled operator.

SUMMARY OF THE INVENTION

The present invention is directed to an apparatus for applying a binding material to the edge of a leg opening in a pair of unfinished men's briefs during the manufacturing thereof. The apparatus includes a holding fixture for receiving and holding the pair of men's briefs before the crotch is sewn such that the edge of the leg opening is stretched longitudinally. A conveyor conveys the holding fixture to a staging mechanism for engaging and positioning the edge of the leg opening while the brief is conveyed in the holding fixture.

The staging mechanism includes a staging platform having a staging surface, a pair of guide blades projecting forwardly from the staging platform for insertion beneath the edges of the leg openings and lifting the edges of the leg opening onto the staging platform and an edge guide for aligning the edge of the leg opening as the pair of men's brief is fed through the sewing apparatus, wherein the staging mechanism disposes the edge of the leg opening in a generally flat condition.

A sewing apparatus disposed adjacent the staging mechanism sews the binding material to the edges of the leg openings as the holding fixture is conveyed through the sewing apparatus. The sewing apparatus includes a pair of sewing machines disposed on opposite sides of the conveying means for simultaneously applying the binding material to the edge of each leg opening in the brief. Trimming means disposed adjacent the output side of the staging mechanism trims the binding material after it is applied to the leg opening.

Accordingly, one aspect of the present invention is to provide an apparatus for applying a binding material to the edge of a leg opening in a pair of unfinished men's briefs during the manufacturing thereof. The apparatus includes: (a) a holding fixture for receiving and holding the pair of men's briefs before the crotch is sewn such that the edge of the leg opening is stretched longitudinally; (b) means for conveying the holding fixture; (c) a staging mechanism for engaging and positioning the edge of the leg opening while the brief is conveyed in the holding fixture, wherein the staging mechanism disposes the edge of the leg opening in a generally flat condition; and (d) a sewing apparatus disposed adjacent the staging mechanism for sewing the binding material to the edges of the leg openings as the holding fixture is conveyed through the sewing apparatus.

Another aspect of the present invention is to provide a staging mechanism for engaging the edges of the leg openings in a pair of unfinished men's briefs and disposing the edges in proper position with respect to a sewing apparatus. The apparatus includes: (a) a staging platform having a staging surface positioned adjacent an input side of the sewing apparatus; (b) a pair of guide blades projecting forwardly from the staging platform for insertion beneath the edges of the leg openings and lifting the edges of the leg opening onto the staging platform; and (c) edge aligning means for aligning the edge of the leg opening with respect to the sewing apparatus as the pair of men's brief is fed through the sewing apparatus.

Still another aspect of the present invention is to provide an apparatus for applying a binding material to the edge of a leg opening in a pair of unfinished men's briefs during the manufacturing thereof. The apparatus includes: (a) a holding fixture for receiving and holding the pair of men's briefs before the crotch is sewn such that the edge of the leg opening is stretched longitudinally; (b) means for conveying the holding fixture; (c) a staging mechanism for engaging and positioning the edge of the leg opening while the brief is conveyed in the holding fixture, the staging mechanism including: (i) a staging platform having a staging surface; (ii) a pair of guide blades projecting forwardly from the staging platform for insertion beneath the edges of the leg openings and lifting the edges of the leg opening onto the staging platform; and (iii) edge aligning means for aligning the edge of the leg opening as the pair of men's brief is fed through the sewing apparatus, wherein the staging mechanism disposes the edge of the leg opening in a generally flat condition; (d) a sewing apparatus disposed adjacent the staging mechanism for sewing the binding material to the edges of the leg openings as the holding fixture is conveyed through the sewing apparatus; and (e) trimming means disposed adjacent the output side of the staging mechanism for trimming the binding material after it is applied to the leg opening.

These and other aspects of the present invention will become apparent to those skilled in the art after a reading of the following description of the preferred embodiment when considered with the drawings.

DESCRIPTION OF THE PREFERRED EMBODIMENTS

Figure 1:
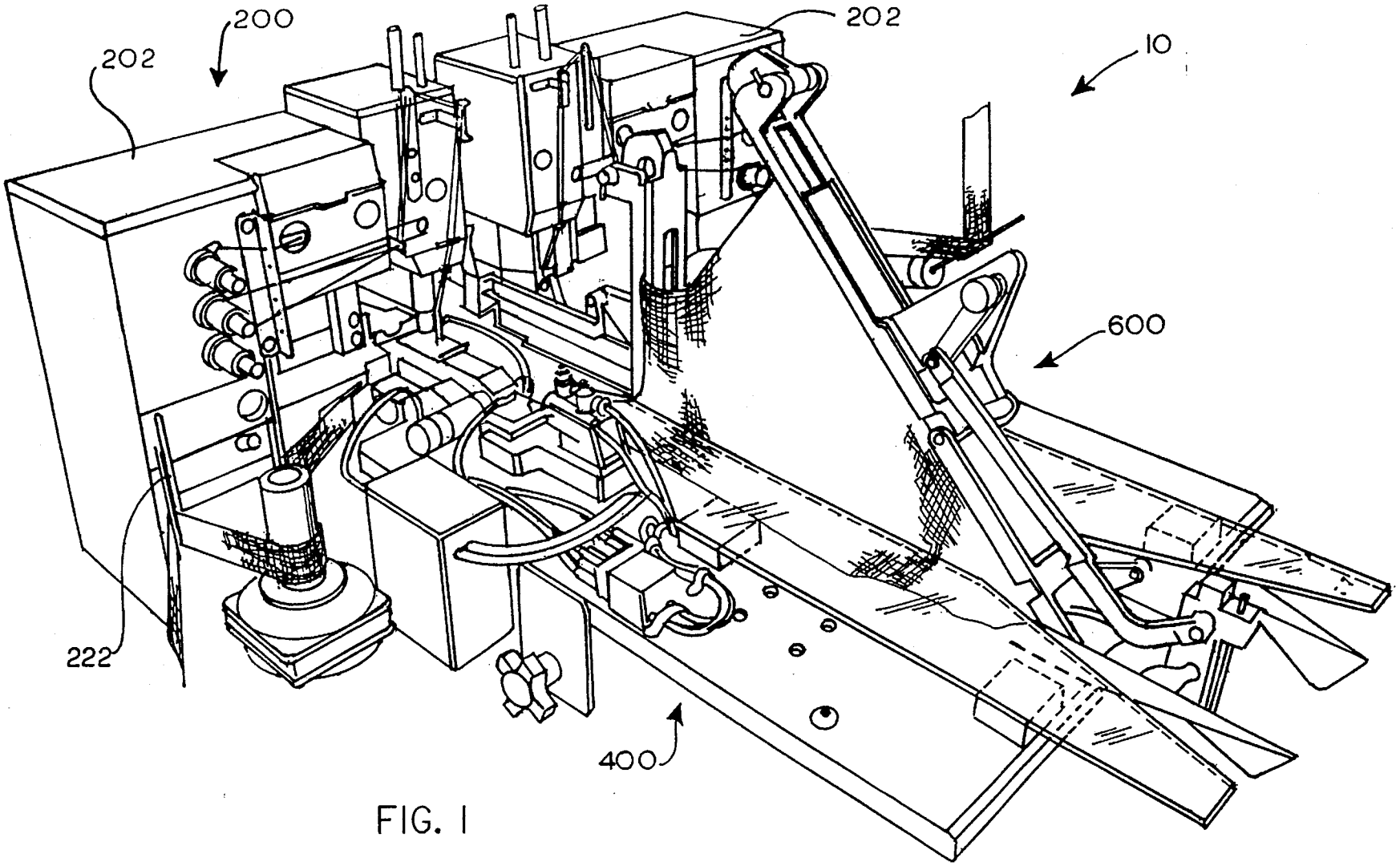
FIG. 1 is a perspective view of a bind-leg apparatus constructed according to the present invention.

In the following description, like reference characters designate like or corresponding parts throughout the several views. Also in the following description, it is to be understood that such terms as "forward", "rearward", "left", "right","upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a bind-leg machine, generally designated 10, is shown. The bind-leg machine 10 is designed to apply binding material around the leg opening of a pair of men's briefs during the manufacture of the brief.

Figure 10:
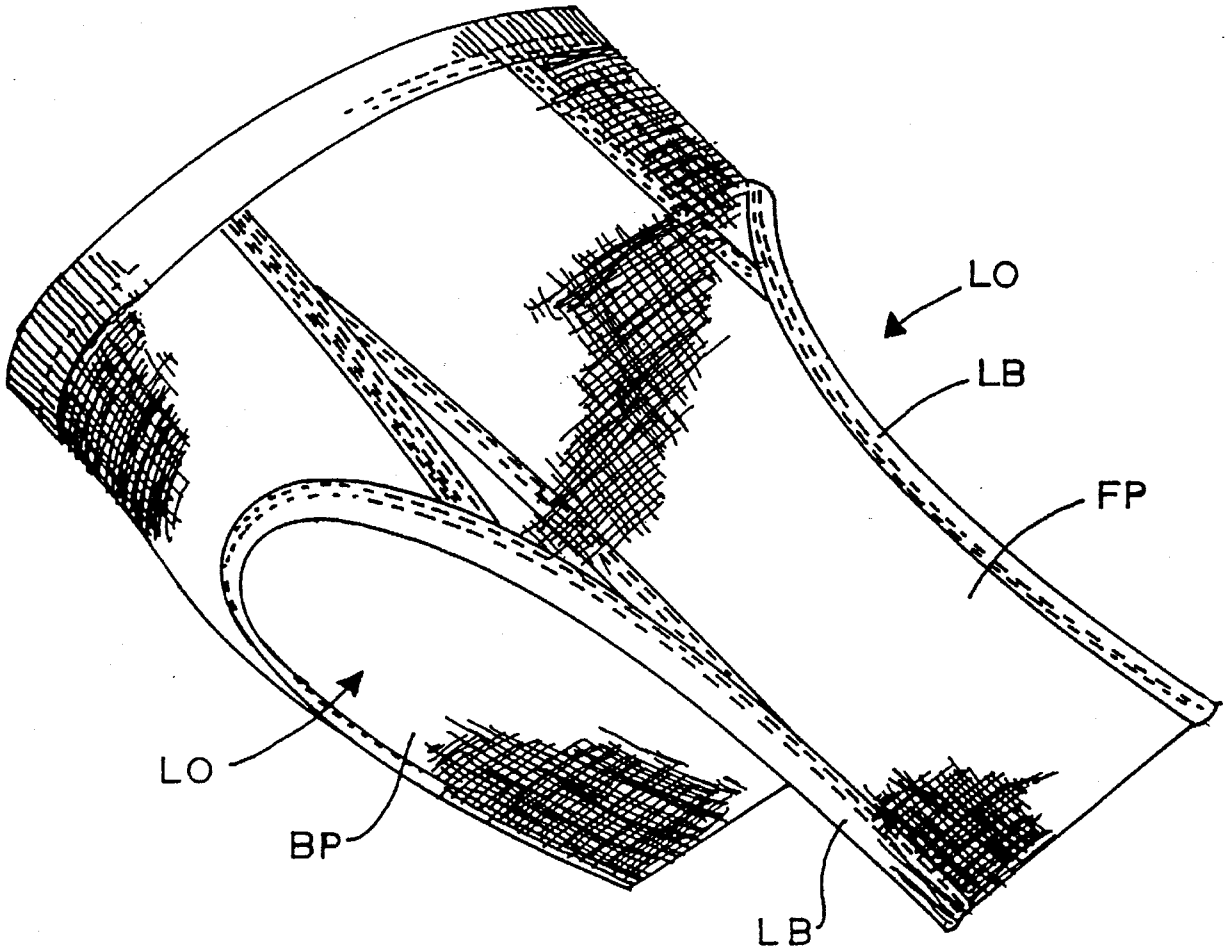
FIG. 10 is a perspective view of an unfinished pair of a men's briefs.

A pair of unfinished men's briefs typically comprises a front panel FP and a back panel BP as shown in FIG. 10. Before the crotch of the brief is sewn, a leg binding LB is applied to edge of each leg opening LO. The bind-leg apparatus of the present invention simultaneously applies the leg binding LB to the edges of both leg openings LO without human intervention.

Figure 2:
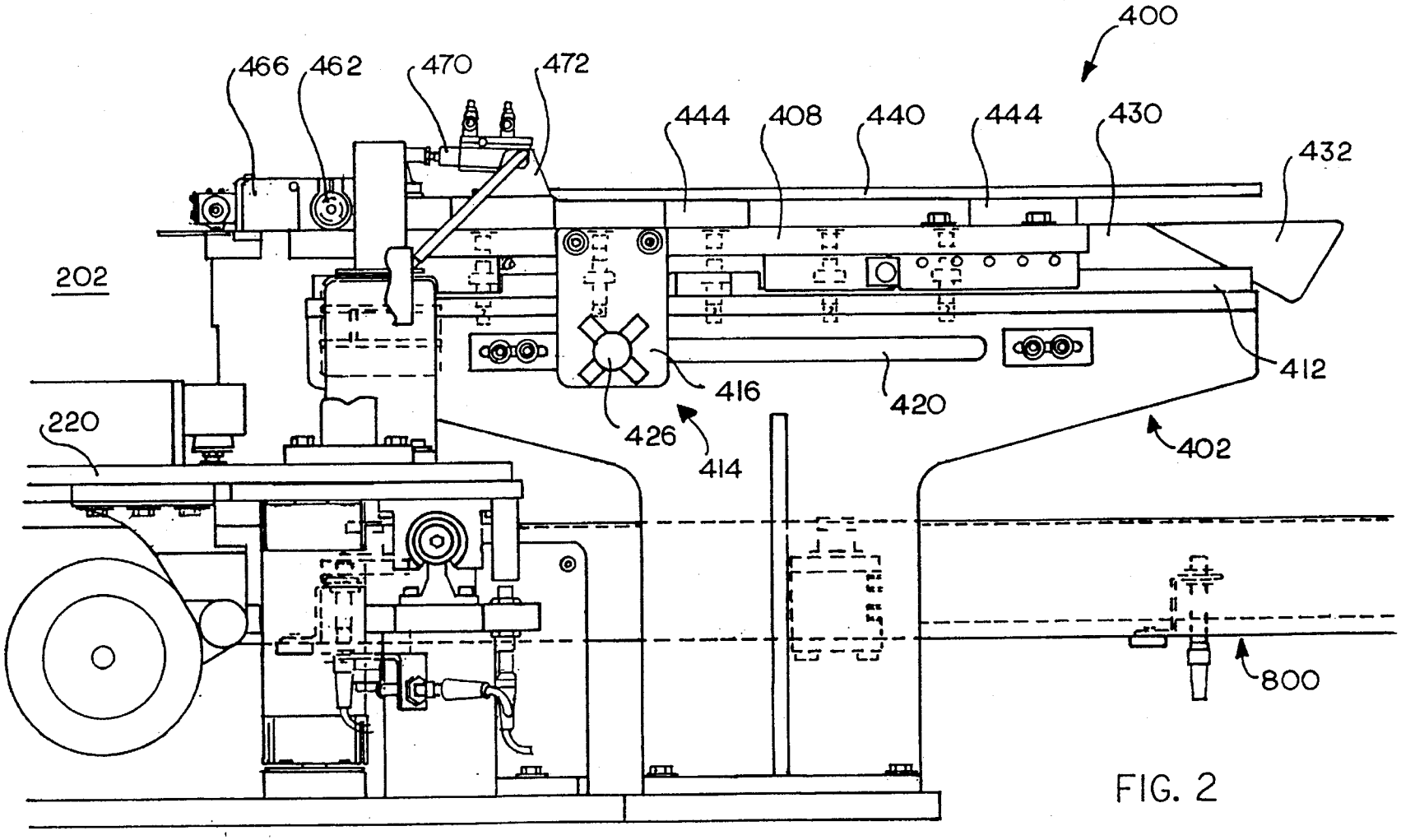
FIG. 2 is a side elevation view of the bind-leg apparatus.
Figure 3:
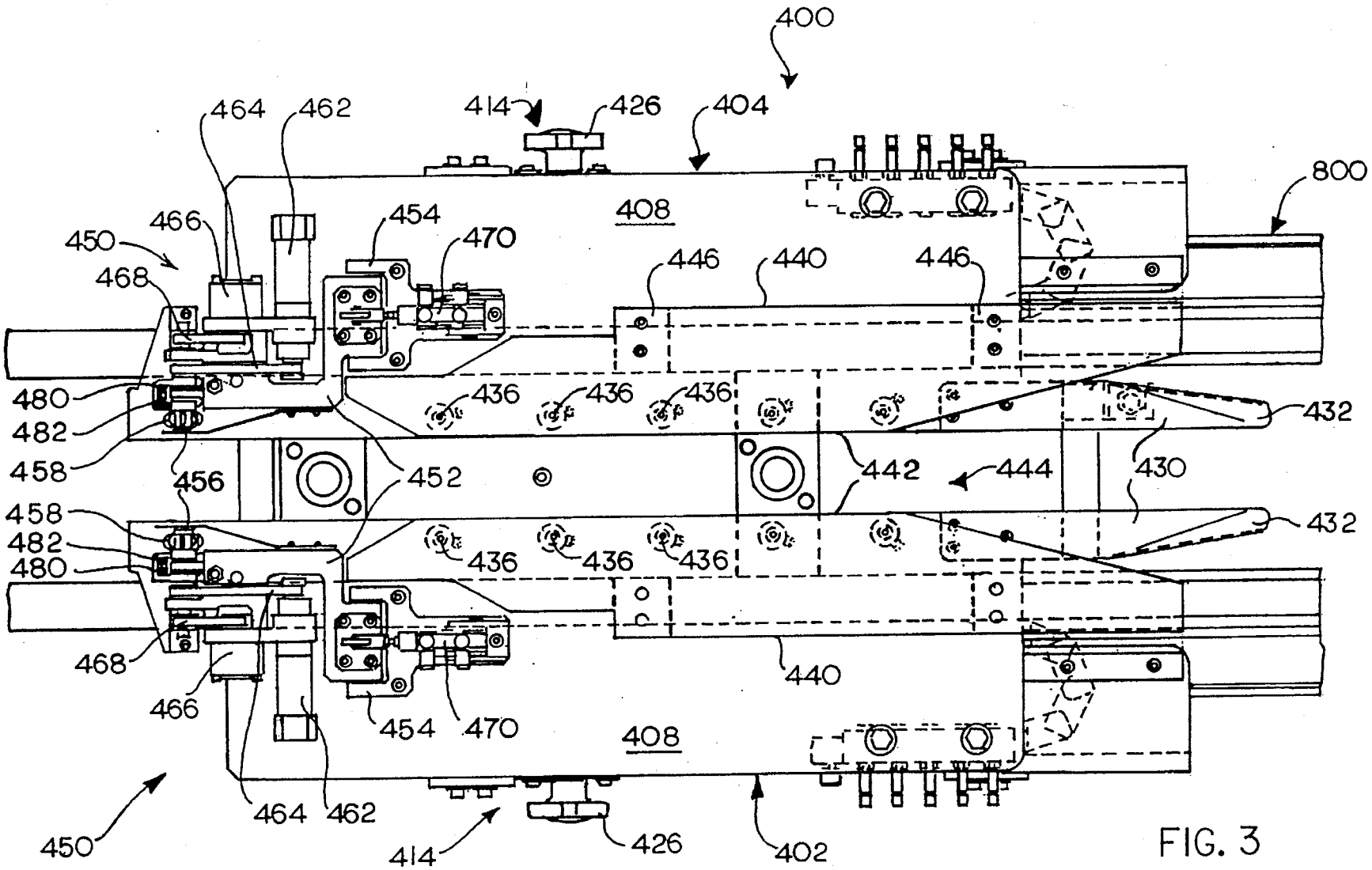
FIG. 3 is a top plan view of the bind-leg apparatus.
Figure 4:
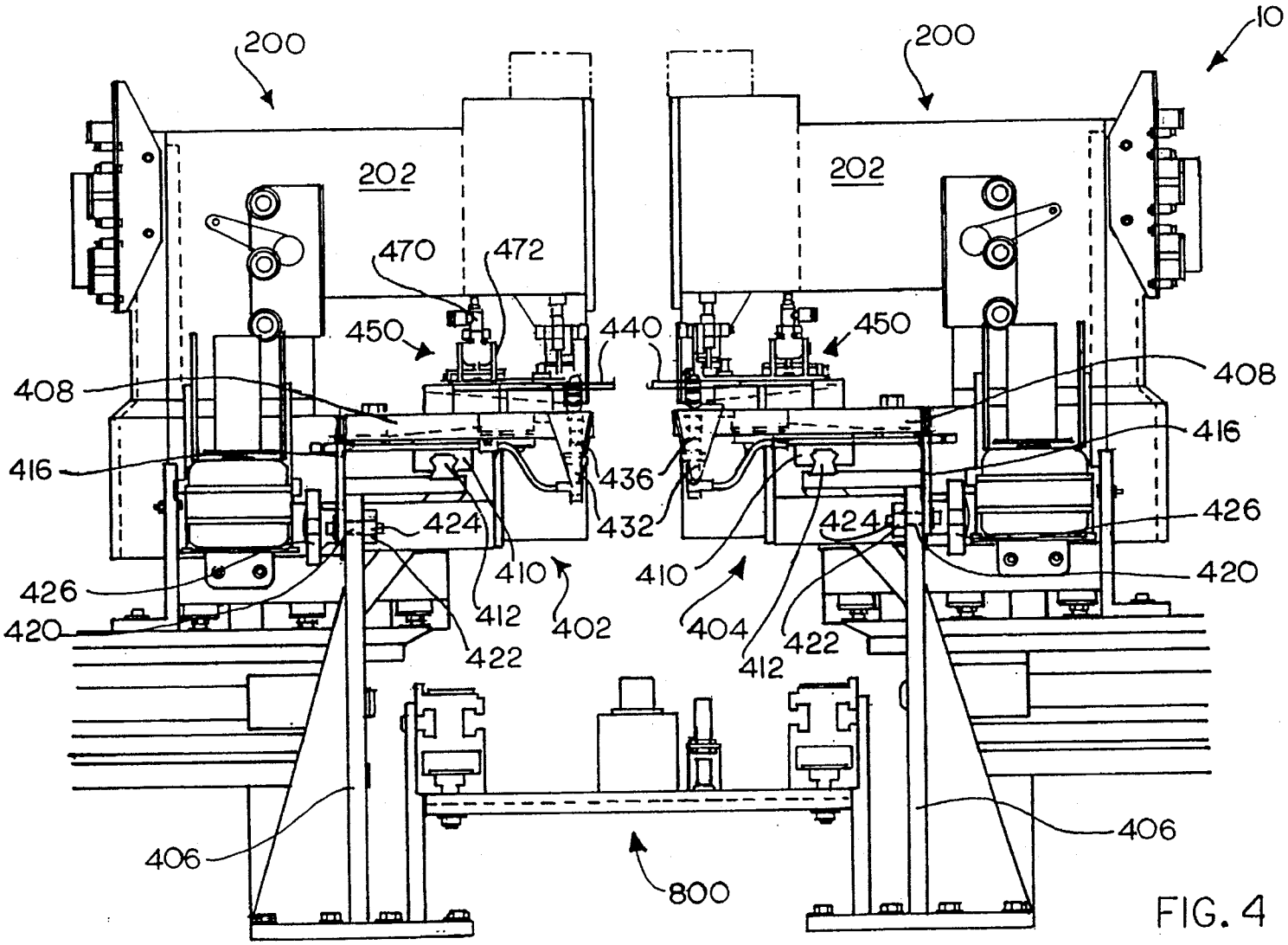
FIG. 4 is a front elevation view of the bind-leg apparatus.

The bind-leg apparatus comprises a holding fixture 600 for holding the unfinished brief, a staging mechanism 400, and a sewing apparatus 200. The holding fixture 600 is transported by a conveyor 800 (FIG. 2) through the staging mechanism 400 and sewing apparatus 200. The binding fixture 600 stretches the unfinished brief such that the edges of the leg opening extend generally longitudinally. The staging mechanism 400 positions the edges of the leg openings LO with respect to the sewing apparatus 200. The sewing apparatus 200 applies the binding to the edges of the leg opening LO while the brief is held in the holding fixture 600.

Turning now to binding fixture 600, the same is shown in detail in FIGS. 6-9. The binding fixture 600 includes a base 602 and two clamping assemblies 630 and 633. Clamping assembly 630 engages the front panel of the men's brief while assembly 633 engages the back panel. The clamping assemblies 630 and 633 are articulated to position the men's briefs in different positions. Also, clamping assembly 633 is movably mounted within a track. 604 on the base for longitudinal movement.

Figure 7:
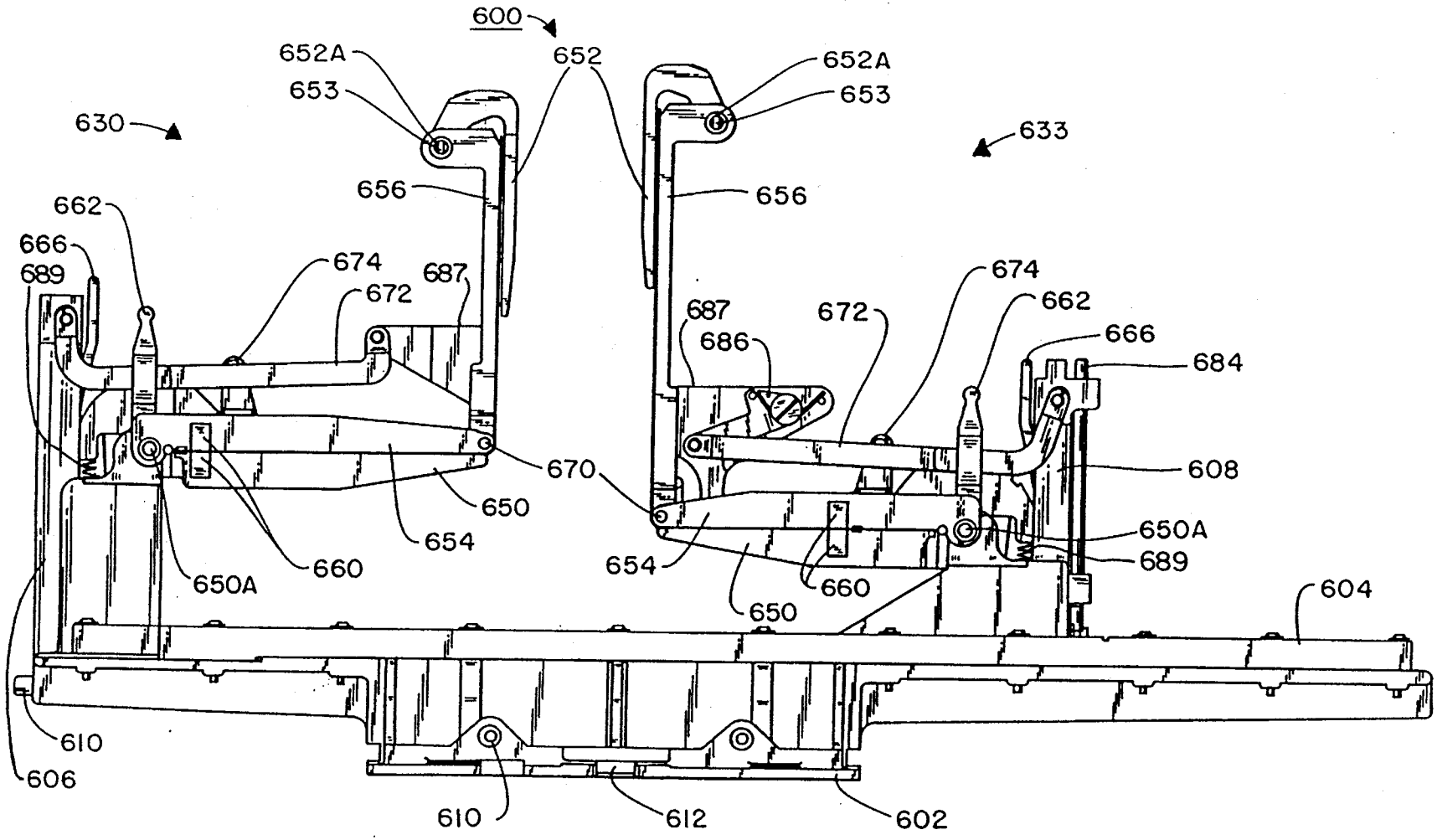
FIG. 7 is a side elevation view of the holding fixture.
Figure 8:
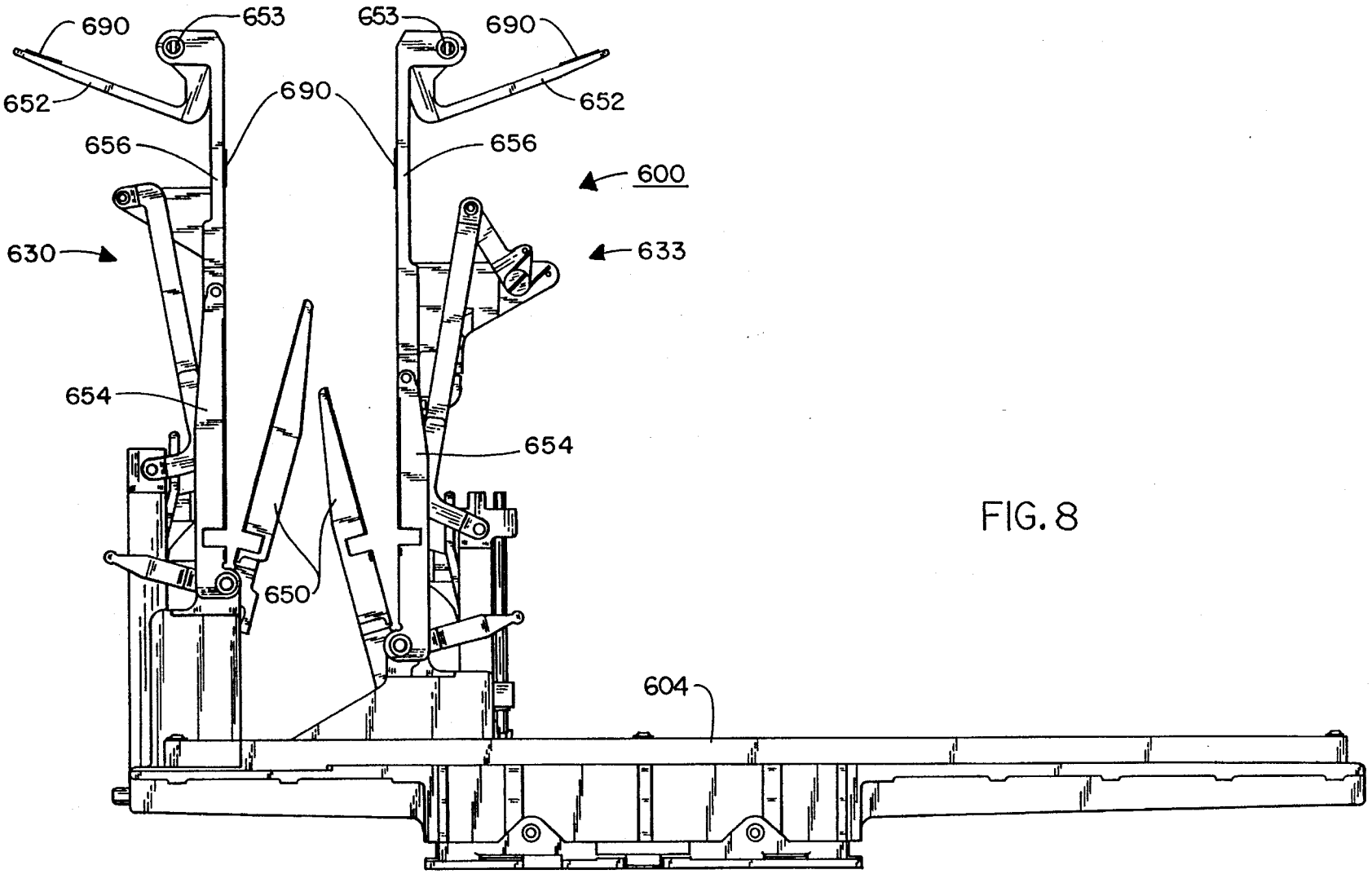
FIG. 8 is a side elevation view of the holding fixture in a receiving position.
Figure 9:
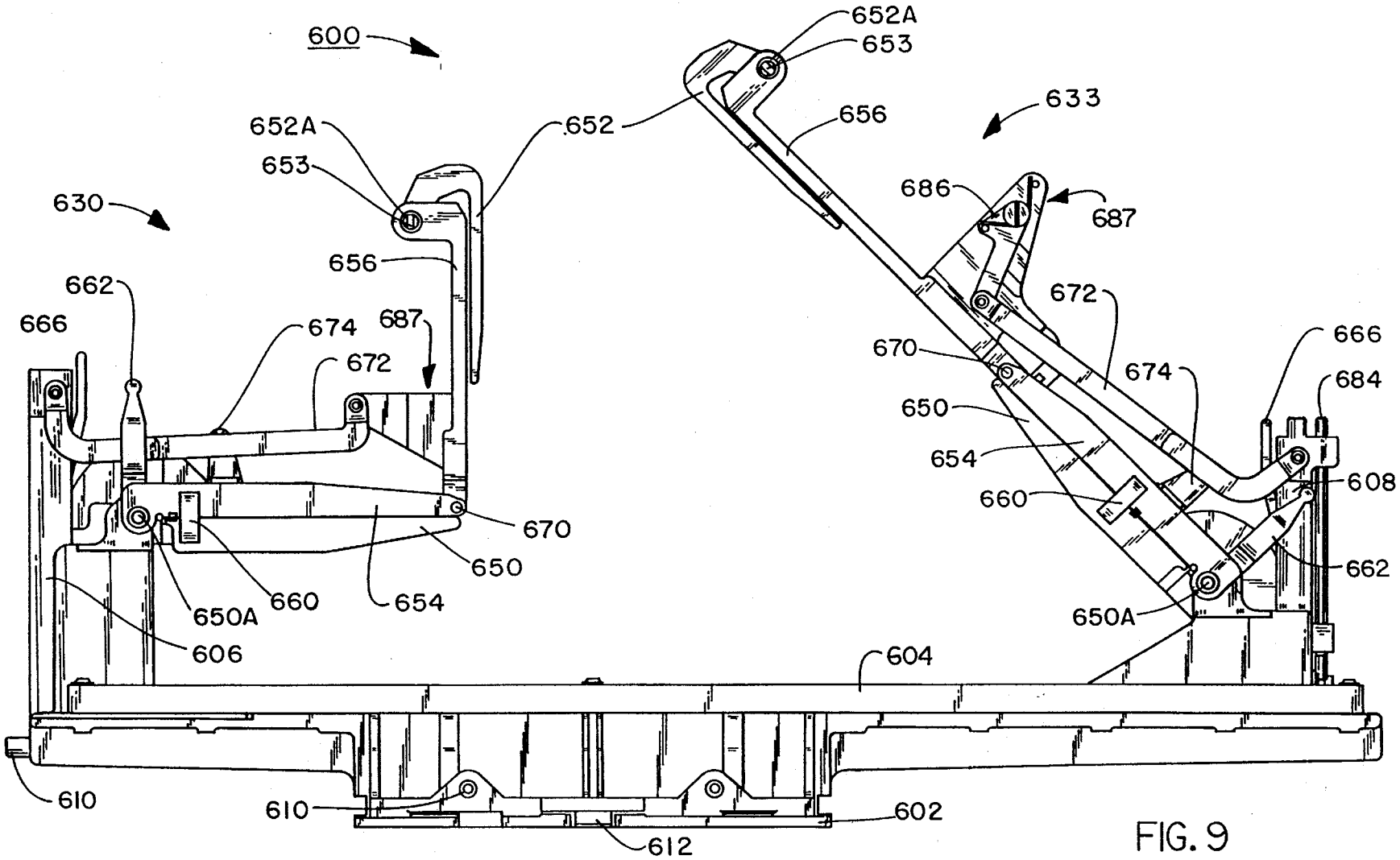
FIG. 9 is a side elevation view of the holding fixture in a binding position.

In FIG. 8, the clamping assemblies 630 and 633 are shown in a receiving position to receive a pair of men's briefs from a transfer mechanism (not shown). After receiving a pair of men's briefs, the clamping assemblies 630 and 633 move to the position shown in FIG. 9. This position is referred to as the binding position. In this position, the edges of the leg opening LO are stretched longitudinally to enable the binding to be applied to the edges. After the binding is applied, the clamping assemblies 630 and 633 move to the position shown in FIG. 7.

The clamping assemblies 630 and 633 are similar in construction. Clamping assembly 630 includes a stationary post 606 which is fixedly secured to the base 602. Clamping assembly 633 includes a movable post 608. A lower leg member 654 is pivotally attached to respective support posts 606, 608. The lower leg member 654 includes a latch plate having a series of notches therein. A latch 666 is mounted to the posts 606, 608 of respective clamping assemblies 630, 633 and engages the notches in the latch plate to retain the clamping assemblies. The clamping assemblies 630, 633 can be pivoted between the receiving position and binding position by pressing the latch 666 forwardly to disengage the end thereof from the latch plate, and then rotating the lower leg members 654.

The upper leg member 656 is pivotally connected to the lower leg member 654 in each clamping assembly 630, 633. In the fixed clamping assembly 630, a link member 672 is connected between the support post 606 and a flange 687 on the upper leg member 656 to maintain the upper leg member 656 in a vertical position. In the moveable clamping assembly 633, the link member 672 is connected between the support post 608 and a swing arm 686. Swing arm 686 is mounted on a flange 687 on the upper leg member 656. When the lower leg member 654 of clamping assembly 633 is lowered from the vertical position shown in FIG. 8, the swing arm 686 rotates so that the angle between the upper leg member 656 and the lower leg member 654 remains at 180° . In the position shown in FIG. 9, the swing arm 686 of clamping assembly 633 engages a swing arm stop. As the lower leg member 654 is lowered to the position shown in FIG. 9, the linkage 672 causes the upper leg member 656 to assume a vertical position as shown in FIG. 7.

Each of the clamping assemblies 630 and 633 includes a pair of clamps for holding the pair of men's briefs. A lower clamp arm 650 is pivotally mounted to the lower leg members 654 and are biased against the lower leg member 654 by springs 689. A clamp control lever 662 is connected to the clamp arm 650 which can be engaged by mechanical means to open and close the clamp arm 650. Slots 660 are formed in the lower leg members 654 and lower clamp arm 650 as shown. The purpose of the slot 660 is to permit removal of the men's brief from the holding fixture 600 after the binding operation is complete.

Upper clamp arms 652 are pivotally mounted to the upper leg members 656 by pivot members 653. The pivot members 653 include an engagement slot **652*a* which can be engaged by mechanical means to rotate the clamp arms 652 to the open position shown in FIG. 8. Upper clamp arm 652 is biased against upper leg member 656 by magnets 690**.

In operation, the holding fixture 600 is placed in the receiving position shown in FIG. 8. The lower clamp arms 650 and upper clamp arms 652 are opened to receive a pair of men's briefs. Once the men's brief is inserted into the holding fixture 600, the clamp arms 650 and 652 are closed and the clamping assemblies 630 and 633 are moved to the position shown in FIG. 9. In this position, the edges of the leg opening are stretched longitudinally. The holding fixture 600 remains in this position while the binding is applied to the edges of the leg openings.

Referring to FIGS. 1–4, the staging apparatus 400 includes two staging assemblies 402 and 404. The staging assemblies 402 and 404 are disposed on opposite sides of the conveyor 800. Staging assembly 402 stages the right side of the garment while staging assembly 404 stages the left side of the garment. Staging assemblies 404 and 402 are identical in construction. Accordingly, only staging assembly 402 is described, it being understood that staging assembly 404 is the same in all respects except opposite hand.

The staging assembly 402 includes a support frame 406 which is mounted on a main frame. A staging platform 408 is slidably mounted on the support frame 406. The staging platform 408 provides a surface for staging the garment as hereinafter described. The staging platform 408 is mounted on a linear slide. The linear slide includes a slide block 410 and a slide rail 412. (See FIG. 4).

During operation, the staging platform 408 is held in a fixed position by a clamp 414. Clamp 414 includes a support plate 416 which is fixed to one side of the staging platform 408. The support plate 416 includes an opening (not shown) which aligns with a slot 420 in the support frame 406. A clamping block 422 is threadably engaged with a threaded shaft 424. The threaded shaft 424 includes a hand knob 426 for tightening and loosening the clamp 414. When the clamp 414 is tightened, the clamping block 422 bears against the inside of the support frame 406 to hold the staging platform 408 in a fixed position. If the staging platform 408 needs to be moved, as in the case of servicing or maintaining the equipment, the knob 426 can be rotated to loosen the clamp 414 and to slide the staging platform 408 along the slide rail 412.

A guide bar 430 is mounted on the front end of the staging platform 408. The guide bar 430 includes an angled-end portion 432. When the holding fixture 600 moves along the conveyor 800 through the staging apparatus 400, the guide bar 430 is inserted underneath the edge of the leg opening LO which hangs downwardly in the holding fixture. 600 The angled-end portions 432 lift the edges to a substantially horizontal position as the edges moves onto the staging platform 408. An air jet (not shown) may be disposed beneath the conveyor to assist in lifting the edges of the leg opening LO.

As the holding fixture 600 moves along the conveyor 800, the fabric slides over the surface of the staging platform 408. To maintain the fabric in a generally flat condition, a series of air jets 436 are disposed along the edges of the staging platform for directing air across the surface of the platform 408 immediately below the edges of the fabric. The air flowing across the surface of the platform 408 forms an air curtain that prevents the edges of the fabric from folding or buckling.

An upper guide 440 is mounted on top of the staging platform 408. The function of the upper guide 440 is to prevent the garment from billowing outwardly and becoming snagged in the sewing apparatus. The upper guide 440 is mounted on spacers 446 and projects over the edge of the fabric. The upper guide 440 includes a guide edge 442 which confines the brief to an area 444 between the staging assemblies 402 and 404.

Figure 5:
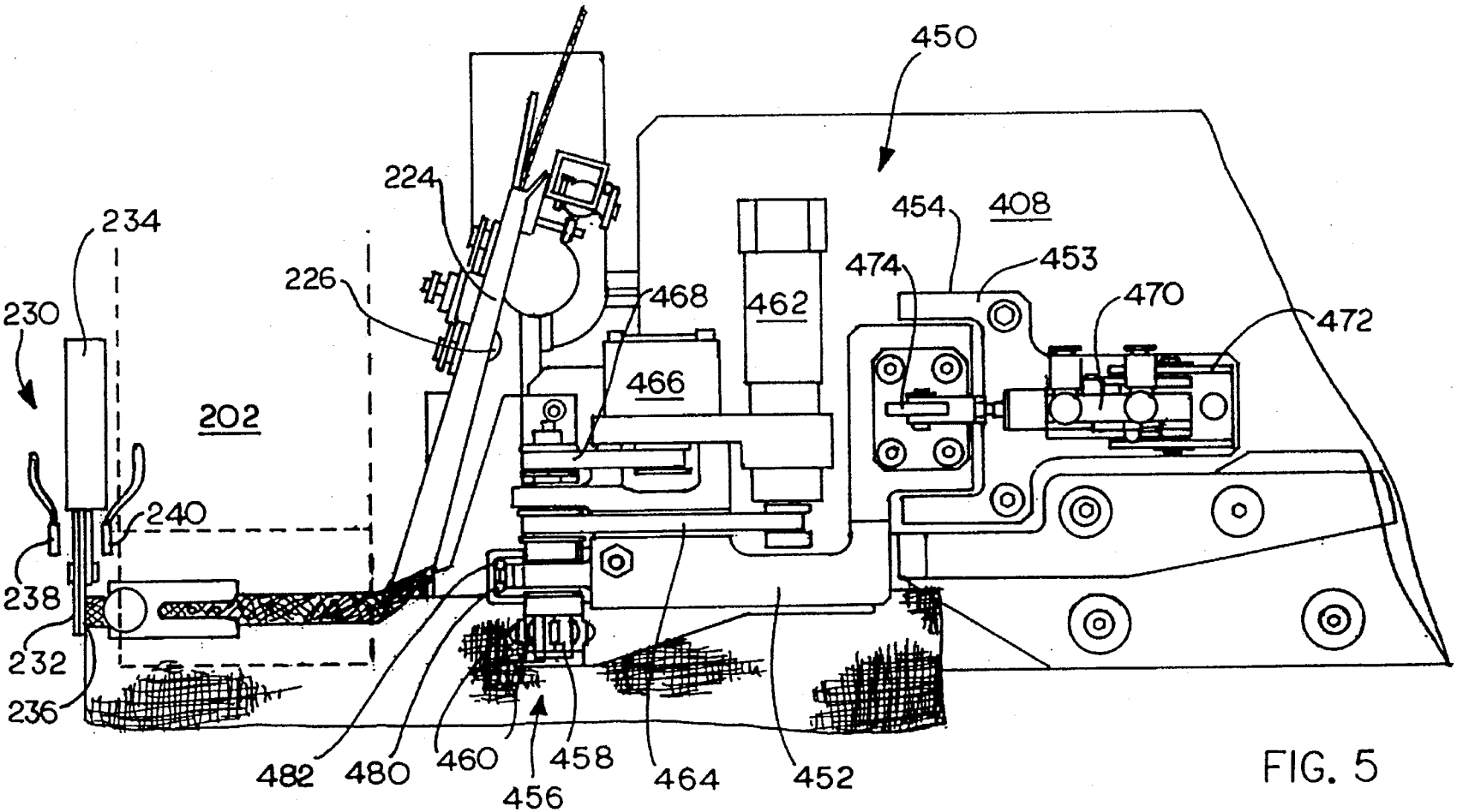
FIG. 5 is a top plan view of the edge guide assembly.
Figure 6:
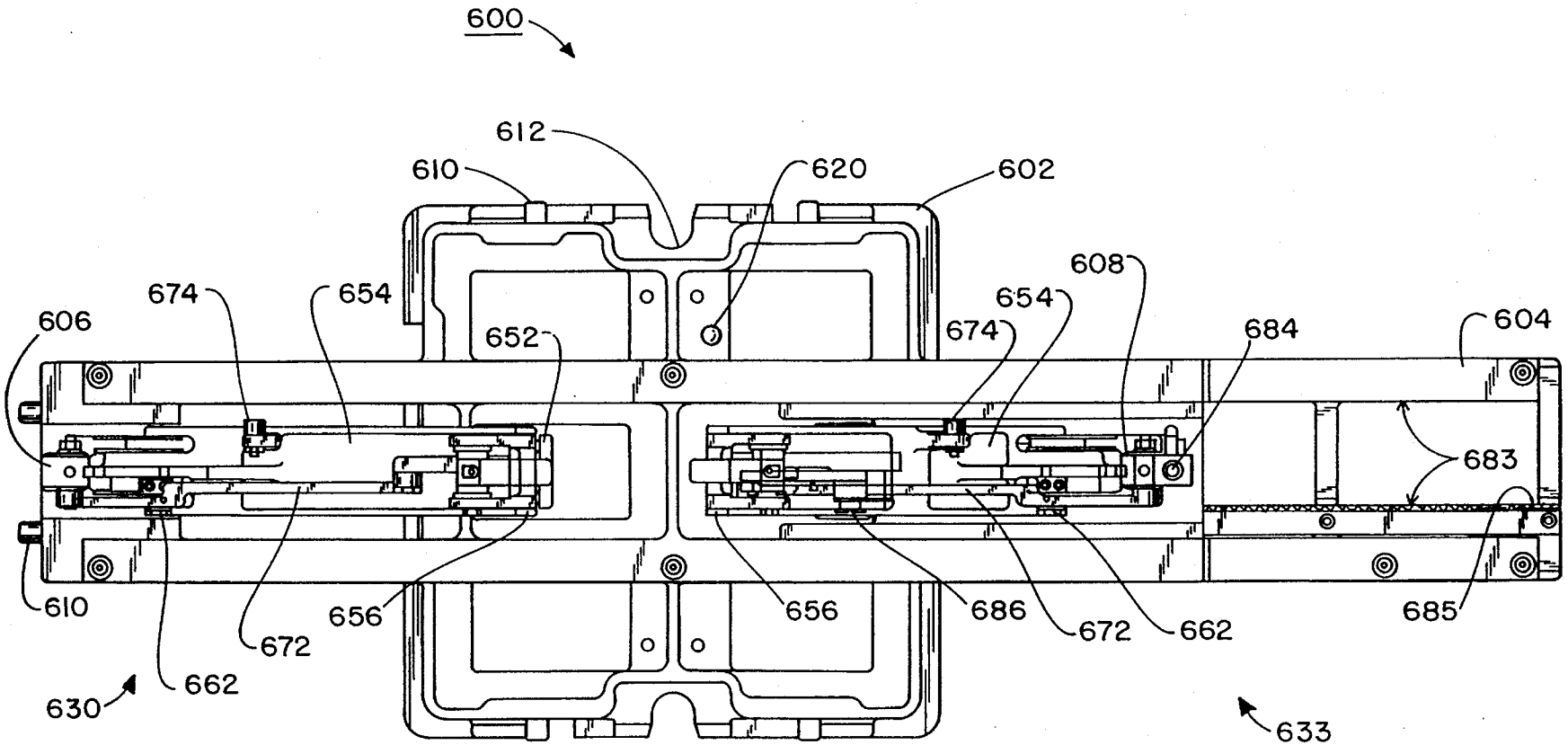
FIG. 6 is a plan view of the holding fixture.

An edge guide assembly 450, shown best in FIG. 5, is mounted on the staging platform 408 immediately adjacent the sewing apparatus 200. The edge guide assembly 450 includes a pivot arm 452 which is mounted to a pivot support 454. An edge guide 456 is mounted on one end of the pivot arm 452. The edge guide 456 is a commercially available product manufactured by Union Special of Chicago, Ill. The edge guide 456 includes a rotor 458 for advancing the fabric and a plurality of guide wheels 460 rotatably mounted on the rotor 458 for adjusting the position of the edge in a direction perpendicular to the direction of feed. Each guide 456 of this type are well-known in the art.

The rotor 458 and guide wheels 460 each include a separate drive. The rotor drive 462 is mounted on the pivot arm 452. A belt 464 connects the rotor drive 462 to the rotor shaft (not shown). The guide wheel drive 466 is also mounted on the pivot arm 452. The guide wheel drive 466 is connected by a belt 468 to the guide wheel drive shaft (not shown). The rotor drive 462 is slaved to the main drive rotor for the sewing apparatus 200 to synchronize the speed of the rotor 458 to the speed of the sewing apparatus.

The pivot arm 454 is raised and lowered with respect to the staging platform 408 by a cylinder 470. The cylinder 470 is mounted on top of the pivot support 454 by means of a bracket 472. The cylinder 470 is connected to a crank arm 474 which is attached to the pivot arm 452. When the cylinder 470 is extended, the pivot arm 452 is lowered onto the staging platform 408. Conversely, when the cylinder 470 is retracted, the pivot arm 452 is raised off the staging platform 408.

In operation, a pair of men's briefs is transported through the staging mechanism by the holding fixture 600. As the holding fixture 600 approaches the staging apparatus 400, the staging guides 430 are inserted beneath the edges of the brief which are lifted to a substantially horizontal position. As the holding fixture 600 moves along the conveyor 800, the edges of the brief move across the staging platform 408. The jets 436 maintain the fabric in a substantially flat condition. The upper guide 440 prevents the top part of the brief from billowing outwardly.

To properly align the edges of the leg openings LO with the sewing apparatus 200, a pair of sensors 480 and 482 are mounted adjacent the edge guide 454 to detect the position of the edge. Preferably, the edge is positioned between the sensors 480 and 482. The sensors 480 and 482 are connected to a controller which controls the guide wheel drive 466. If both sensors 480, 482 detect the garment, the guide wheels 458 on the edge guide 454 are rotated in one direction to move the edge inwardly. Conversely, if neither sensor 480, 482 detects the garment, the guide wheels 458 on the edge guide 454 are rotated in the opposite direction to move the edge of the brief outwardly.

The sewing apparatus 200 comprises two sewing machines 202 for applying a binding to the edges of respective leg openings LO. The sewing machines 202 are disposed on opposite sides of the conveyor 800 and are spaced sufficiently far apart from one another to allow passage therebetween of the holding fixture 600. Each sewing machine 202 is mounted on a moveable platform 220. Each sewing machine 202 is a conventional sewing machine which is driven by a servo-motor (not shown).

Binding material is fed through the sewing machine 202 in a conventional fashion. The binding is fed from a pay-out roll (not shown) and passes around a series of guide bars. The guide bars assure that the binding material remains in a flat and unfolded condition. The binding material passes through a folder 224 (FIG. 5) which is mounted to the arm of the sewing machine 202. The folder 224 aligns the binding material with the sewing head. Additionally, the folder 224 folds the binding material around the edge of the leg opening (LO) as the brief is transported through the sewing apparatus 200. In a preferred embodiment of the invention, the folder also includes a guide for positioning an elastic band within the folded binding material.

A trimmer 230 for severing the binding material is mounted adjacent to the output side of each sewing machine 202. The trimmer 230, shown schematically in FIG. 5, includes a blade 232 which is connected to a cylinder 234. The cylinder 234 raises and lowers the blade 232 at the appropriate time to sever the binding material between the blade 232 and a shear stop 236.

To determine when to actuate the trimmer 230, a pair of sensors 238 and 240 are mounted on opposite sides of the trimmer 230. When the sensor 240 detects the end of the front panel FP, the trimmer 230 is actuated to sever the binding as close as possible to the end of the front panel FP. Similarly, when sensor 238 detects the end of the back panel BP, the trimmer 230 is again actuated to sever the binding closely adjacent the end of the back panel BP.

As the holding fixture is conveyed through the sewing apparatus, the binding material is applied to the edges of the leg opening LO in the manner which is well known to those skilled in the art. That is, the binding material is folded and sewn to the edge of the leg opening. The holding fixture 600 and staging mechanism 400 allows binding to be applied to both leg openings LO simultaneously.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for applying a binding material to the edge of a leg opening in a pair of unfinished men's briefs during the manufacturing thereof, said apparatus comprising:

(a) a holding fixture for receiving and holding said pair of men's briefs before the crotch is sewn such that the edge of the leg opening is positioned along a substantially straight line;

(b) means for conveying said holding fixture;

(c) a staging mechanism for engaging and positioning the edge of the leg opening while said brief is conveyed in said holding fixture, wherein said staging mechanism disposes the edge of the leg opening in a generally flat condition; and (d) a sewing apparatus disposed adjacent the staging mechanism for sewing the binding material to the edges of the leg openings as the holding fixture is conveyed through the sewing apparatus by said means for conveying said holding fixture.

2. The apparatus according to claim 1, wherein the sewing apparatus comprises a pair of sewing machines disposed on opposite sides of said conveying means for simultaneously applying the binding material to the edge of each leg opening in said brief.

3. The apparatus according to claim 1, further including trimming means disposed adjacent the downstream side of said apparatus for trimming said binding material after it is applied to said leg opening.

4. The apparatus according to claim 3, further including a sensor positioned adjacent said trimming means for detecting a portion of said brief and actuating said trimming means.

5. A staging mechanism for engaging the edges of the leg openings in a pair of unfinished men's briefs and disposing said edges in proper position with respect to being fed through a sewing apparatus, said apparatus comprising:

(a) a staging platform having a staging surface positioned adjacent an input side of the sewing apparatus;

(b) a pair of guide blades projecting forwardly from the staging platform for insertion beneath the edges of the leg openings and lifting the edges of the leg opening onto the staging platform; and (c) edge aligning means for aligning the edge of the leg opening with respect to the sewing apparatus as the pair of men's brief is fed through the sewing apparatus.

6. The apparatus according to claim 5, further including a plurality of air jets for forming an air curtain on said staging surface of the staging platform.

7. The apparatus according to claim 5, further including an upper guide disposed in spaced relation to the staging platform.

8. The apparatus according to claim 5, wherein the edge aligning means includes an edge guide having a plurality of guide wheels for engaging and moving the edge of said leg opening in a direction perpendicular to the direction of feed.

9. The apparatus according to claim 8, wherein the edge guide is mounted above the staging platform and is moveable between a raised position and a lowered position with respect to the staging platform.

10. The apparatus according to claim 8, further including at least one edge sensor for detecting the edge of said leg opening as the brief is conveyed through said sewing apparatus and providing a control signal to said edge guide.

11. The apparatus according to claim 10, further including an outer edge sensor and an inner edge sensor which are laterally spaced with respect to one another.

12. An apparatus for applying a binding material to the edge of a leg opening in a pair of unfinished men's briefs during the manufacturing thereof, said apparatus comprising:

(a) a holding fixture for receiving and holding said pair of men's briefs before the crotch is sewn such that the edge of the leg opening is positioned along a substantially straight line;

(b) means for conveying said holding fixture;

(c) a staging mechanism for engaging and positioning the edge of the leg opening while said brief is conveyed in said holding fixture, said staging mechanism including: (i) a staging platform having a staging surface; (ii) a pair of guide blades projecting forwardly from the staging platform for insertion beneath the edges of the leg openings and lifting the edges of the leg opening onto the staging platform; and (iii) edge aligning means for aligning the edge of the leg opening as the pair of men's brief is fed through the sewing apparatus by said means for conveying said holding fixture, wherein said staging mechanism disposes the edge of the leg opening in a generally flat condition;

(d) a sewing apparatus disposed adjacent the staging mechanism for sewing the binding material to the edges of the leg openings as the holding fixture is conveyed through the sewing apparatus by said means for conveying said holding fixture; and (e) trimming means disposed adjacent the downstream side of said staging mechanism for trimming said binding material after it is applied to said leg opening.

13. The apparatus according to claim 12, wherein the sewing apparatus comprises a pair of sewing machines disposed on opposite sides of said conveying means for simultaneously applying the binding material to the edge of each leg opening in said brief.

14. The apparatus according to claim 12, further including a sensor positioned adjacent said trimming means for detecting a portion of said brief and providing a control signal to said trimming means.

15. The apparatus according to claim 12, further including a plurality of air jets for forming an air curtain on said staging surface of the staging platform.

16. The apparatus according to claim 12, further including an upper guide disposed in spaced relation to the staging platform.

17. The apparatus according to claim 12, wherein the edge aligning means includes an edge guide having a plurality of guide wheels for engaging and moving the edge of said leg opening in a direction perpendicular to the direction of feed.

18. The apparatus according to claim 17, wherein the edge guide is mounted above the staging platform and is moveable between a raised position and a lowered position with respect to the staging platform.

19. The apparatus according to claim 17, further including at least one edge sensor for detecting the edge of said leg opening as the brief is conveyed through said sewing apparatus and providing a control signal to said edge guide.

20. The apparatus according to claim 19, further including an outer edge sensor and an inner edge sensor which are laterally spaced with respect to one another.

21. A method for applying a binding material to the edge of a leg opening in a pair of unfinished men's briefs during the manufacturing thereof, said method comprising the steps of:

(a) receiving and holding said pair of men's briefs in a holding fixture before the crotch is sewn such that the edge of the leg opening is positioned along a substantially straight line;

(b) conveying said holding fixture;

(c) engaging and positioning the edge of the leg opening in a staging mechanism while said brief is conveyed in said holding fixture, wherein said staging mechanism disposes the edge of the leg opening in a generally flat condition; and (d) sewing the binding material to the edges of the leg openings in a sewing apparatus disposed adjacent the staging mechanism at the same time the holding fixture is conveyed through the sewing apparatus.

22. A method for engaging the edges of the leg openings in a pair of unfinished men's briefs and disposing said edges in proper position with respect to a sewing apparatus, said method comprising the steps of:

(a) positioning a staging platform having a staging surface adjacent an input side of the sewing apparatus;

(b) inserting a pair of guide blades projecting forwardly from the staging platform beneath the edges of the leg openings;

(c) lifting the edges of the leg opening onto the staging platform; and (d) aligning the edge of the leg opening with respect to the sewing apparatus in an edge aligning means at the same time the pair of men's brief is fed through the sewing apparatus.

23. A method for applying a binding material to the edge of a leg opening in a pair of unfinished men's briefs during the manufacturing thereof, said method comprising the steps of:

(a) receiving and holding said pair of men's briefs in a holding fixture before the crotch is sewn such that the edge of the leg opening is positioned along a substantially straight line;

(b) conveying said holding fixture;

(c) engaging and positioning the edge of the leg opening in a staging mechanism while said brief is conveyed in said holding fixture, said staging mechanism including: (i) a staging platform having a staging surface; (ii) a pair of guide blades projecting forwardly from the staging platform for insertion beneath the edges of the leg openings and lifting the edges of the leg opening onto the staging platform; and (iii) edge aligning means for aligning the edge of the leg opening at the same time the pair of men's brief is fed through the sewing apparatus, wherein said staging mechanism disposes the edge of the leg opening in a generally flat condition;

(d) sewing the binding material to the edges of the leg openings in a sewing apparatus disposed adjacent the staging mechanism at the same time the holding fixture is conveyed through the sewing apparatus; and (e) trimming said binding material in a trimming means disposed adjacent the downstream side of said staging mechanism after it is applied to said leg opening.

* * * * *